US007243732B2

(12) United States Patent
Richard

(10) Patent No.: US 7,243,732 B2
(45) Date of Patent: Jul. 17, 2007

(54) ZONAL ISOLATION USING ELASTIC MEMORY FOAM

(75) Inventor: Bennett Richard, Kingwood, TX (US)

(73) Assignee: Baker Hughes Incorporated, Houston, TX (US)

( * ) Notice: Subject to any disclaimer, the term of this patent is extended or adjusted under 35 U.S.C. 154(b) by 216 days.

(21) Appl. No.: 10/937,027

(22) Filed: Sep. 9, 2004

(65) Prior Publication Data

US 2005/0067170 A1 Mar. 31, 2005

Related U.S. Application Data

(60) Provisional application No. 60/506,119, filed on Sep. 26, 2003.

(51) Int. Cl.
*E21B 33/12* (2006.01)

(52) U.S. Cl. ..... 166/387; 166/118; 166/180; 166/206

(58) Field of Classification Search ..... None
See application file for complete search history.

(56) References Cited

U.S. PATENT DOCUMENTS

| | | | | |
|---|---|---|---|---|
| 4,454,756 | A * | 6/1984 | Sharp et al. | 73/152.54 |
| 4,515,213 | A * | 5/1985 | Rogen et al. | 166/123 |
| 6,431,282 | B1 | 8/2002 | Bosma et al. | |
| 6,446,717 | B1 * | 9/2002 | White et al. | 166/187 |
| 6,668,928 | B2 | 12/2003 | Brothers | |
| 2002/0157831 | A1 * | 10/2002 | Kurlenya et al. | 166/302 |
| 2004/0055760 | A1 | 3/2004 | Nguyen | |
| 2004/0164499 | A1 | 8/2004 | Murakami et al. | |

* cited by examiner

*Primary Examiner*—Zakiya W. Bates
(74) *Attorney, Agent, or Firm*—Gerald W Spinks

(57) ABSTRACT

A method and apparatus for forming an elastic memory foam into an expansion element with an outer diameter larger than a borehole, heating the expansion element to its transition temperature and compressing it to a smaller run-in diameter, cooling the compressed expansion element below its transition temperature and running it into the borehole, then raising the expansion element to its transition temperature to cause it to expand and seal against the borehole wall. Expansion can be enhanced by expanding a mandrel on which the expansion element is formed.

11 Claims, 3 Drawing Sheets

ZONAL ISOLATION USING ELASTIC MEMORY FOAM

CROSS REFERENCE TO RELATED APPLICATIONS

This application relies upon U.S. Provisional Pat. App. No. 60/506,119, filed Sep. 26, 2003, for "Zonal Isolation Using Elastic Memory Foam".

STATEMENT REGARDING FEDERALLY SPONSORED RESEARCH OR DEVELOPMENT

Not Applicable

BACKGROUND OF THE INVENTION

1. Field of the Invention

This invention is in the field of methods and apparatus for isolating one zone of an oil or gas well bore from another zone.

2. Background Art

It is common to drill an oil or gas well bore into and through several different zones, where the zones are layered vertically. In such cases, it is typical to isolate each zone from the zones above and below it by installing a packer in the well bore between zones, surrounding a tubular element, such as production piping, which is used to access the various zones. Known systems for achieving this isolation commonly use inflatable or mechanically expandable packers. The inflated packers can be filled with various fluids or even cement. These types of packers can be expensive, and setting them in place can be complicated, since electrical or mechanical systems are usually required for the setting operation. These packers are also less effective in open hole applications than in cased hole applications, because they sometimes do not truly conform to the irregular walls of the open hole, resulting in a limited pressure seal capacity.

BRIEF SUMMARY OF THE INVENTION

The present invention is a method and apparatus for isolating zones in an open hole with an elastic memory based foam packer. The memory based foam is formed onto a base element, such as a mandrel or another tubular element, to form a packer with an outer diameter slightly larger than the downhole diameter in which the packer will be used. Then, the foam is elevated to a temperature at which it begins to soften, called the transition temperature, and the outside diameter of the foam is compressed to a smaller diameter. Once compressed, the foam is then cooled below the transition temperature, causing it to harden at this desired, smaller, run-in diameter. Then, the packer is run into the hole as an element of a tubular string, placing the packer at the depth where zone isolation is required. Once at this depth, the foam is then raised above the transition temperature, causing it to tend to return to its original, larger, outer diameter. Since the original diameter is larger than the hole diameter, the packer conforms to the bore hole and exerts an effective pressure seal on the bore hole wall. As an alternative, the mandrel or other base element can be hollow, and it can be expanded either before, during, or after the temperature-induced expansion of the foam expansion element. This expansion can be achieved by a mechanical, hydraulic, or hydro-mechanical device. Expansion of the mandrel can enhance the overall expansion achieved with a given amount of foam expansion, and it can increase the resultant pressure exerted by the expansion element on the borehole wall, thereby creating a more effective seal.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
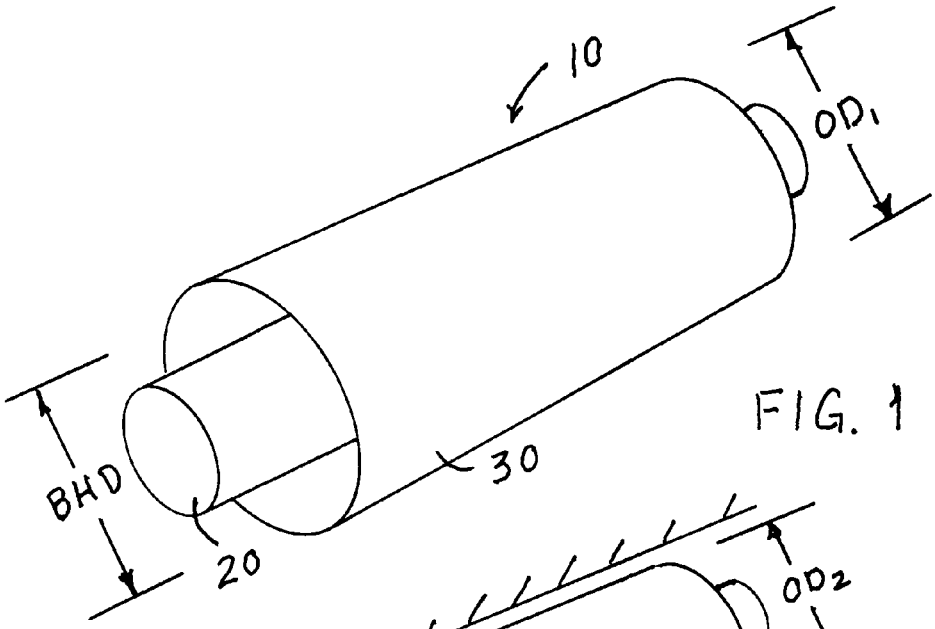
FIG. 1 is a perspective view of the apparatus of the present invention, in its originally formed size and shape.

As shown in FIG. 1, the apparatus of the present invention is a packer 10 having a base element, such as a tubular element or a mandrel 20, on which is formed a foam expansion element 30. The mandrel 20 can be any desired length or shape, to suit the desired application, and it can be hollow if required. It can also have any desired connection features, such as threaded ends. The expansion element 30 is shown with a cylindrical shape, but this can be varied, such as by means of concave ends or striated areas (not shown), to facilitate deployment, or to enhance the sealing characteristics of the packer. The expansion element 30 is composed of an elastic memory foam such as Tembo™ foam, an open cell syntactic foam manufactured by Composite Technology Development, Inc. This type of foam has the property of being convertible from one size and shape to another size and/or shape, by changing the temperature of the foam. This type of foam can be formed into an article with an original size and shape as desired, such as a cylinder with a desired outer diameter. The foam article thusly formed is then heated to raise its temperature to its transition temperature. As it achieves the transition temperature, the foam softens, allowing the foam article to be reshaped to a desired interim size and shape, such as by being compressed to form a smaller diameter cylinder. The temperature of the foam article is then lowered below the transition temperature, to cause the foam article to retain its interim size and shape. When subsequently raised again to its transition temperature, the foam article will return to its original size and shape.

In the present invention, the cylindrical foam expansion element 30 can be originally formed onto the mandrel 20 by wrapping a foam blanket onto the mandrel 20, with the desired original outer diameter $OD_1$. Alternatively, the process for forming the expansion element 30 on the mandrel 20 can be any other process which results in the expansion element 30 having the desired original diameter, such as by molding the foam directly onto the mandrel 20. The desired original outer diameter $OD_1$ is larger than the bore hole diameter BHD (shown for reference in FIG. 1) in which the packer 10 will be deployed. For instance, an expansion element 30 having an original outer diameter $OD_1$ of 10 inches might be formed for use in an 8.5 inch diameter borehole.

Then, the temperature of the expansion element 30 is raised above the transition temperature of the foam material, which causes the foam to soften. At this point, the expansion element 30 is compressed to a smaller interim outer diameter $OD_2$. For instance, the expansion element 30 might be compressed to an interim outer diameter $OD_2$ of 7.5 inches for use in an 8.5 inch diameter borehole. This facilitates running the packer 10 into the borehole. This type of foam may be convertible in this way to an interim size and shape approximately one third the volume of the original size and shape. After compression, the expansion element 30 is lowered below its transition temperature, causing it to retain its smaller interim outer diameter $OD_2$. This cooling step can be achieved by exposure to the ambient environment, or by exposure to forced cooling.

Figure 2:
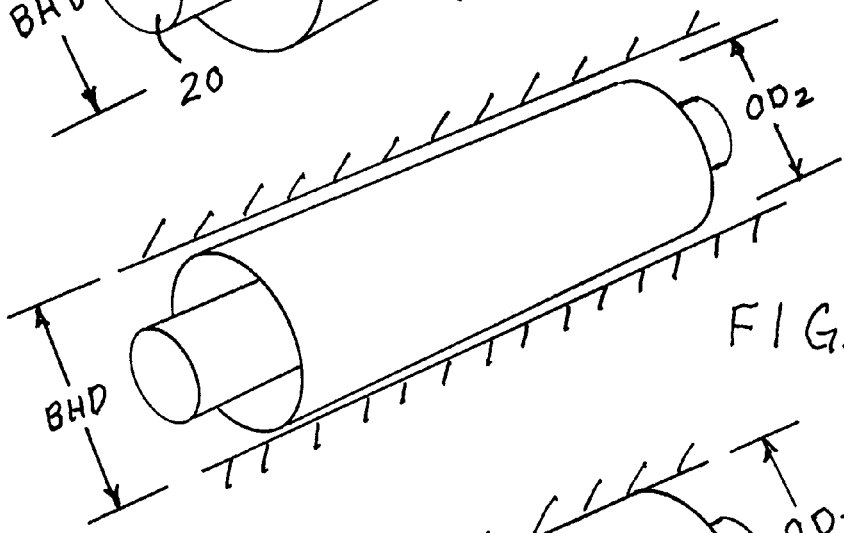
FIG. 2 is a perspective view of the apparatus shown in FIG. 1, compressed to its interim size and shape.
Figure 3:
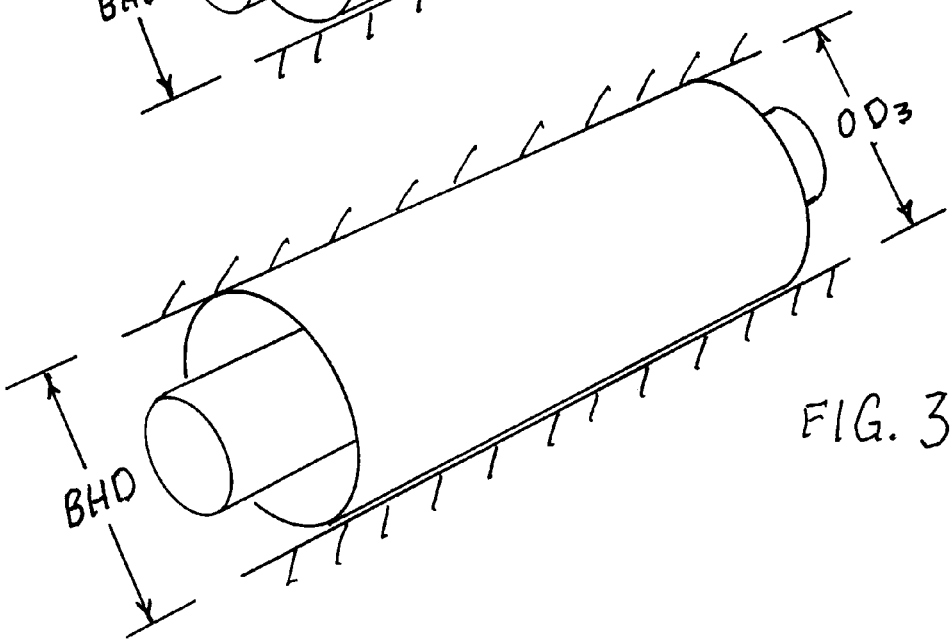
FIG. 3 is a perspective view of the apparatus shown in FIG. 1, expanded to seal against the borehole wall.

After compression and cooling, the packer 10 is lowered into the borehole to the desired depth at which zonal isolation is to occur, as shown in FIG. 2. Once the packer 10 is located at the desired depth for isolating the borehole, the expansion element 30 is again raised to the transition temperature of the foam. As shown in FIG. 3, this causes the expansion element 30 to expand to a final outer diameter $OD_3$. Because of the properties of the elastic memory foam, the expansion element 30 attempts to return to the original outer diameter $OD_1$. However, since the original outer diameter $OD_1$ was selected to be larger than the borehole diameter BHD, the expansion element 30 can only expand until the final outer diameter $OD_3$ matches the borehole diameter BHD. This can cause the expansion element 30 to exert a pressure of between 300 and 500 psi on the borehole wall.

The foam material composition is formulated to achieve the desired transition temperature. This quality allows the foam to be formulated in anticipation of the desired transition temperature to be used for a given application. For instance, in use with the present invention, the foam material composition can be formulated to have a transition temperature just slightly below the anticipated downhole temperature at the depth at which the packer 10 will be used. This causes the expansion element 30 to expand at the temperature found at the desired depth, and to remain tightly sealed against the bore hole wall. Downhole temperature can be used to expand the expansion element 30; alternatively, other means can be used, such as a separate heat source. Such a heat source could be a wireline deployed electric heater, or a battery fed heater. For example, such a heat source could be mounted to the mandrel 20, incorporated into the mandrel 20, or otherwise mounted in contact with the foam expansion element 30. The heater could be controlled from the surface of the well site, or it could be controlled by a timing device or a pressure sensor. Still further, an exothermic reaction could be created by chemicals pumped downhole from the surface, or heat could be generated by any other suitable means.

Figure 4:
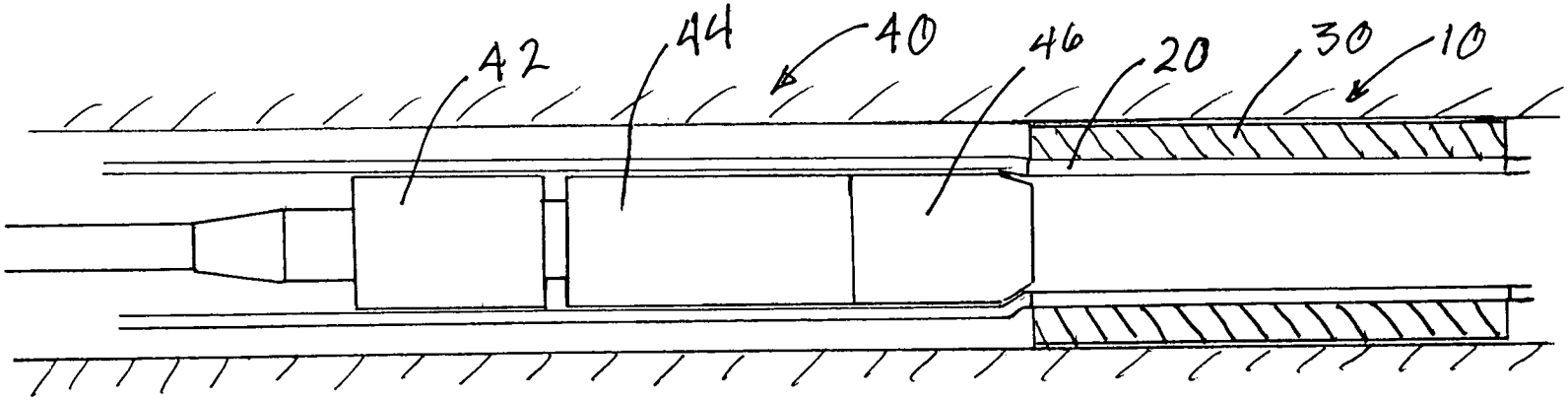
FIGS. 4 and 5 are partial section views of the apparatus of the present invention, implementing a hydro-mechanical device to expand the mandrel.
Figure 5:
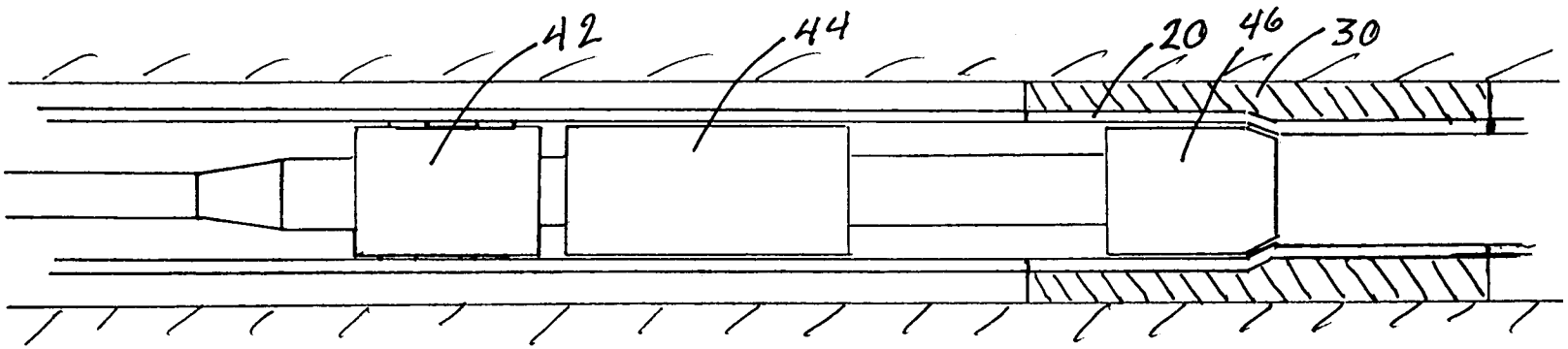

As an alternative, if it is desired to enhance the overall amount of packer expansion achievable, in addition to the thermal expansion achievable with a given volume of foam, the mandrel 20 itself can be a hollow base element which can be expanded radially. This additional expansion can be achieved by the use of a mechanical, hydraulic, or hydro-mechanical device. For example, as shown in FIG. 4, a hydro-mechanical expander 40 can be run into the tubing on a work string, either before, during, or after the thermal expansion of the foam. The hydro-mechanical expander 40 can consist essentially of an anchoring device 42, a hydraulic ram 44, and a conical pig 46. Once the conical pig 46 reaches the mandrel 20, the anchoring device 42 is activated to anchor itself to the tubing. Activation of the anchoring device 42 can be mechanical, electrical, or hydraulic, as is well known in the art. Once the expander 40 is thusly anchored in place, the hydraulic ram 44 can be pressurized to force the conical pig 46 into and through the mandrel 20 of the packer 10, as shown in FIG. 5. Since the outer diameter of the conical pig 46 is selected to be slightly larger than the inner diameter of the mandrel 20, as the conical pig 46 advances through the mandrel 20, it radially expands the mandrel 20.

As mentioned above, this expansion of the mandrel 20 can be implemented before, during, or after the thermal expansion of the foam expansion element 30. It can be seen that radial expansion of the mandrel 20 in this way can enhance the overall expansion possible with the packer 10. Therefore, for a given amount of foam material in the expansion element 30, the final diameter to which the packer 10 can be expanded can be increased, or the pressure exerted by the expanded packer 10 can be increased, or both. For example, a relatively smaller overall diameter packer 10 can be run into the hole, thereby making the running easier, with mandrel expansion being employed to achieve the necessary overall expansion. Or, a relatively larger overall diameter packer 10 can be run into the hole, with mandrel expansion being employed to achieve a higher pressure seal against the borehole wall.

Figure 7:
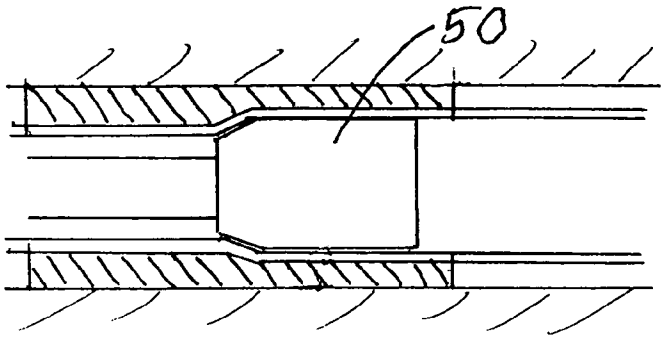
FIGS. 6 and 7 are partial section views of the apparatus of the present invention, implementing a mechanical device to expand the mandrel.
Figure 6:
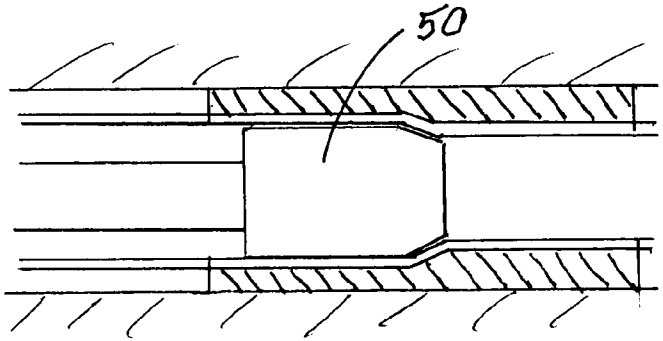
Figure 8:
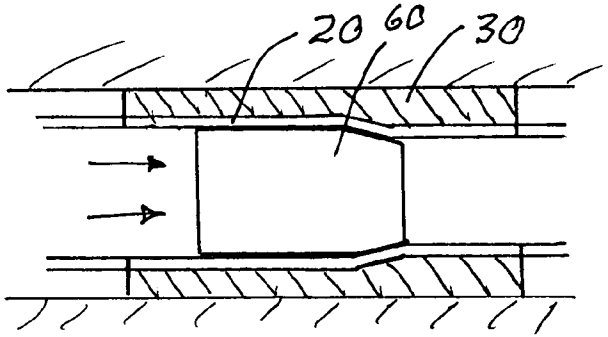
FIG. 8 is a partial section view of the apparatus of the present invention, implementing a hydraulic device to expand the mandrel.

As a further alternative to use of the hydro-mechanical expander 40, the mandrel 20 can be expanded by mechanically forcing a conical pig 50 through the mandrel 20 with a work string, as shown in FIGS. 6 and 7. Forcing of the pig 50 through the mandrel 20 can be either by pushing with the work string, as shown in FIG. 6, or by pulling with the work string, as shown in FIG. 7. Still further, the mandrel 20 can be expanded by hydraulically forcing a conical pig 60 through the mandrel 20 with mud pump pressure, as shown in FIG. 8.

While the particular invention as herein shown and disclosed in -detail is fully capable of obtaining the objects and providing the advantages hereinbefore stated, it is to be understood that this disclosure is merely illustrative of the presently preferred embodiments of the invention and that no limitations are intended other than as described in the appended claims.

I claim:

1. A method for zonal isolation of an oil or gas well borehole, said method comprising:

forming an elastic memory foam expansion element on a base element, said foam expansion element having an original outer diameter larger than a selected borehole diameter;

raising said foam expansion element to its transition temperature;

radially compressing said foam expansion element to an interim outer diameter smaller than said selected borehole diameter;

cooling said compressed foam expansion element below its transition temperature;

running said compressed foam expansion element into a borehole on said base element; and raising said foam expansion element to its transition temperature, to thereby radially expand said foam expansion element to seal between said base element and said borehole.

2. The method recited in claim 1, further comprising:

forming said foam expansion element on a hollow mandrel;

attaching said hollow mandrel to said base element; and radially expanding said hollow mandrel.

3. The method recited in claim 2, wherein said radial expansion of said hollow mandrel is employed prior to said radial expansion of said foam expansion element.

4. The method recited in claim 2, wherein said radial expansion of said hollow mandrel is employed during said radial expansion of said foam expansion element.

5. The method recited in claim 2, wherein said radial expansion of said hollow mandrel is employed after said radial expansion of said foam expansion element.

6. The method recited in claim 2, further comprising:

anchoring a hydro-mechanical expander within said base element; and activating said hydro-mechanical expander to force a conical pig through said hollow mandrel, to achieve said radial expansion of said hollow mandrel.

7. The method recited in claim 2, further comprising:

lowering a conical pig through said base element on a work string; and forcing said conical pig through said hollow mandrel with said work string, to achieve said radial expansion of said hollow mandrel.

8. The method recited in claim 7, wherein said conical pig is pushed through said hollow mandrel.

9. The method recited in claim 7, wherein said conical pig is pulled through said hollow mandrel.

10. The method recited in claim 2, further comprising:

pumping a conical pig through said base element with fluid pressure; and forcing said conical pig through said hollow mandrel with said fluid pressure, to achieve said radial expansion of said hollow mandrel.

11. A packer for zonal isolation of an oil or gas well borehole, said packer comprising:

a mandrel; and a substantially cylindrical expansion element formed on said mandrel, said expansion element being formed of elastic memory foam, said expansion element having first and second stable states;

wherein said foam expansion element in said first stable state has an outer diameter larger than a selected diameter;

wherein said expansion element is convertible to said second stable state by being raised to its transition temperature, compressed to an outer diameter smaller than said selected diameter, then cooled below its transition temperature;

wherein said expansion element is convertible back to said first stable state by again being raised to its transition temperature; and wherein said elastic memory foam is formulated to have said transition temperature below an anticipated downhole temperature at a selected depth in a borehole, and said selected diameter is a diameter of said borehole.

* * * * *